US005114449A

United States Patent [19]

Agrawal et al.

[11] Patent Number: 5,114,449

[45] Date of Patent: May 19, 1992

[54] ENHANCED RECOVERY OF ARGON FROM CRYOGENIC AIR SEPARATION CYCLES

[75] Inventors: Rakesh Agrawal, Allentown; Donald W. Woodward, New Tripoli, both of Pa.

[73] Assignee: Air Products and Chemicals, Inc., Allentown, Pa.

[21] Appl. No.: 573,952

[22] Filed: Aug. 28, 1990

[51] Int. Cl.[5] ..... F25J 3/04

[52] U.S. Cl. ..... 62/22; 55/66; 62/24

[58] Field of Search ..... 62/22, 24; 55/66

[56] References Cited

U.S. PATENT DOCUMENTS

| | | | |
|---|---|---|---|
| 4,605,427 | 8/1986 | Erickson | 62/22 |
| 4,670,031 | 4/1986 | Erickson | 62/22 |
| 4,822,395 | 4/1989 | Cheung | 62/22 |

OTHER PUBLICATIONS

Latimer, R. E., "Distillation of Air", Chemical Engineering Progress, 63(2) 35-39 [1967].

*Primary Examiner*—Ronald C. Capossela

*Attorney, Agent, or Firm*—Willard Jones, II; William F. Marsh; James C. Simmons

[57] ABSTRACT

The present invention relates to an improvement for the production of argon from cryogenic air separation processes. In particular, the improvement provides a better method of thermally linking the top of the crude argon column with the low pressure column. In the improvement, the argon-rich, overhead vapor from the top of the crude argon column is condensed in a boiler/condenser by indirect heat exchange against liquid descending the low pressure column; a portion of the condensed argon-rich, overhead vapor is returned to the top of the crude argon column to provide reflux. The most suitable location for such boiler/condenser is as an intermediate boiler/condenser in the low pressure column, particularly, the section of the low pressure column bounded by the feed point of the crude liquid oxygen from the bottom of the high pressure column and the vapor feed draw line for the crude argon column wherein an adequate temperature difference exists between the descending liquid and the condensing argon.

6 Claims, 4 Drawing Sheets

ENHANCED RECOVERY OF ARGON FROM CRYOGENIC AIR SEPARATION CYCLES

TECHNICAL FIELD

The present invention is related to a process for the cryogenic distillation of air using a multiple column distillation system to produce argon, in addition to nitrogen and/or oxygen.

BACKGROUND OF THE INVENTION

Argon is a highly inert element over a very wide range of conditions, both at cyrogenic and very high temperatures. It is used in the steel-making, light bulbs and electronics industries, for welding and in gas chromatography. The major source of argon is that found in the air and it is typically produced therefrom using cryogenic air separation units. The world demand for argon is increasing and thus it is essential to develop an efficient process which can produce argon at high recoveries using cryogenic air separation units.

Historically, the typical cryogenic air separation unit used a double distillation column of the Linde-type with a crude argon (or argon side arm) column to recover argon from air. A good example of this typical unit is disclosed in an article by Latimer, R.E., entitled "Distillation of Air", in *Chemical Engineering Progress,* 63 (2), 35–39 [1967]). A conventional unit of this type is shown in FIG. 1, which is discussed later in this disclosure.

However, this conventional process has some shortcomings. U.S. Pat. No. 4,670,031 discusses in detail these shortcomings and explains the problems which limit the amount of crude argon recovery with the above configuration. This can be easily explained. For a given production of oxygen and nitrogen products, the total boilup and hence the vapor flow in the bottommost section (between the bottom of the column and the withdraw line for the crude argon column) of the low pressure column is nearly fixed. As this vapor travels up the low pressure column it is split between the feed to the crude argon column and the vapor proceeding up the low pressure column. The gaseous feed to the top of the section of the low pressure column above the withdraw for the crude argon column (Section 11) is derived by the near total vaporization of a portion of the crude liquid oxygen stream in the boiler/condenser located at the top of the crude argon column. The composition of this gaseous feed stream is typically 35–40% oxygen. A minimum amount of vapor is needed in Section II of the low pressure column—the amount necessary for it to reach the composition at the feed introduction point without pinching in this section. Since the composition of gaseous feed stream is essentially fixed, the maximum flow of vapor which can be sent to the crude argon column is also limited. This limits the argon which can be recovered from this process.

In order to increase argon recovery, it is desirable to increase the flow of vapor to the crude argon column. This implies that the vapor flow through Section II of the low pressure column must be decreased (as total vapor flow from the bottom of the low pressure column is nearly fixed). One way to accomplish this would be to increase the oxygen content of the gaseous feed stream to the top of the Section II of the low pressure column because that would decrease the vapor flow requirement through this section of the low pressure column. However, since this gaseous feed stream is derived from the crude liquid oxygen, its composition is fixed within a narrow range as described above. Therefore, the suggested solution is not possible with the current designs and the argon recovery is thus limited.

U.S. Pat No. 4,670,031 suggests a method to increase the argon recovery and partially overcomes the above discussed deficiency. This is achieved by the use of an additional boiler/condenser. This additional boiler/condenser allows the exchange of latent heats between an intermediate point of the crude argon column and a location in Section II of the low pressure column. Thus a vapor stream is withdrawn from an intermediate height of the crude argon column and is condensed in this additional boiler/condenser and sent back as intermediate reflux to the crude argon column. The liquid to be vaporized in this boiler/condenser is withdrawn from the Section 11 of the low pressure column and the heated fluid is sent back to the same location in the low pressure column. A boiler/condenser is also used at the top of the crude argon column to provide the reflux needed for the top section of this column. A portion of the crude liquid oxygen is vaporized in this top boiler/condenser analogous to the conventional process. The use of the additional boiler/condenser provides some of the vapor at a location in Section II where oxygen content in the vapor stream is higher than that in the crude liquid oxygen stream. This decreases the minimum vapor flow requirement of this section and thereby allows an increased vapor flow to the bottom of the crude argon column. This leads to an increase in argon recovery.

Even though the method suggested in the U.S. Pat. No. 4,670,031 leads to an increase in argon recovery, it is not totally effective. This is due to the fact that all the vapor feed to the crude argon column does not reach the top of this column and an increased L/V is used in the bottom section of this column. Since argon is withdrawn from the top of the crude argon column and a certain L/V is needed in the top section to achieve the desired crude argon purity, the relatively lower vapor flow in the top section (as compared to the bottom section) limits the argon recovery. It is desirable to have a scheme, which will produce an increased vapor flow in the top section of the crude argon column so that argon can be recovered in even greater quantities.

U.S. Pat. No. 4,822,395 teaches another method of argon recovery. In this method all the crude liquid oxygen from the bottom of the high pressure column is fed to the low pressure column. The liquid from the bottom of the low pressure column is let down in pressure and boiled in the boiler/condenser located at the top of the crude argon column. The crude argon column overhead vapor is condensed in this boiler/condenser and provides reflux to this column. There are some disadvantages of this method. The liquid from the bottom of the low pressure column is nearly pure oxygen and since it condenses the crude argon overhead vapor, its pressure when boiled will be much lower than the low pressure column pressure. As a result, the oxygen gas recovered will be at a pressure which is significantly lower than that of the low pressure column and when oxygen is a desired product this represents a loss of energy. Furthermore, this arrangement requires that the low pressure column operates at a pressure which is significantly higher than the ambient pressure. If nitrogen is not a desired product or if it is not needed at a higher pressure then this process will require excessive energy consumption. Another drawback of the suggested solution is that since crude argon overhead is condensed against pure oxygen, the amount of vapor which can be fed to the crude argon column is limited by the amount of oxygen present in the air. In some cases, this can lead to lower argon recoveries.

There is clearly a need for a process which does not have above mentioned shortcomings and can produce argon with greater recoveries.

SUMMARY OF THE INVENTION

The present invention is an improvement to a cryogenic air distillation process producing argon using a multiple column distillation system comprising a high pressure column, a low pressure column and a crude argon column. In the process, feed air is compressed, cooled to near its dew point, and fed to the high pressure column. In the high pressure column, the compressed, cooled feed air is rectified into a crude liquid oxygen bottoms and a high pressure nitrogen overhead. The crude liquid oxygen is subcooled and fed to the low pressure column. In the low pressure column, the crude liquid oxygen is distilled into a liquid oxygen bottoms and a gaseous nitrogen overhead. The low pressure column and the high pressure column are thermally linked such that the high pressure nitrogen overhead is condensed in a reboiler/condenser against vaporizing liquid oxygen bottoms. An argon containing side stream is removed from a lower intermediate location of the low pressure column and fed to the crude argon column. In the crude argon column, the argon containing side stream is rectified into an argon-rich vapor overhead and an argon-lean bottoms liquid; the argon-lean bottoms liquid is returned to the low pressure column.

The improvement to the process comprises condensing at least a portion of the argon-rich vapor overhead from the crude argon column by indirect heat exchange in a boiler/condenser against at least a portion of liquid descending the low pressure column selected from a location of the low pressure column between the feed point of the crude liquid oxygen from the bottom of the high pressure column and the removal point for the argon containing gaseous side stream for the crude argon column wherein an adequate temperature difference exists between the descending liquid and the condensing argon, thereby at least partially vaporizing said liquid portion; and returning at least a portion of the condensed argon to the top of the crude argon column to provide liquid reflux.

The process of the present invention can further comprise using at least a portion of said at least partially vaporized liquid portion to provide reflux to the low pressure column.

Finally, the process of the present invention can also further comprise condensing a portion of the vapor ascending the intermediate section of the crude argon column by indirect heat exchanger in a second boiler/condenser against liquid descending the low pressure column bounded by the location of the liquid used to condense at least a portion of the argon-rich vapor overhead and the removal point for the argon containing gaseous side stream for the crude argon column and using said condensed portion as intermediate reflux for the crude argon column.

The above boiler/condensers can be either internal or external to the columns.

DETAILED DESCRIPTION OF THE INVENTION

Figure 1:
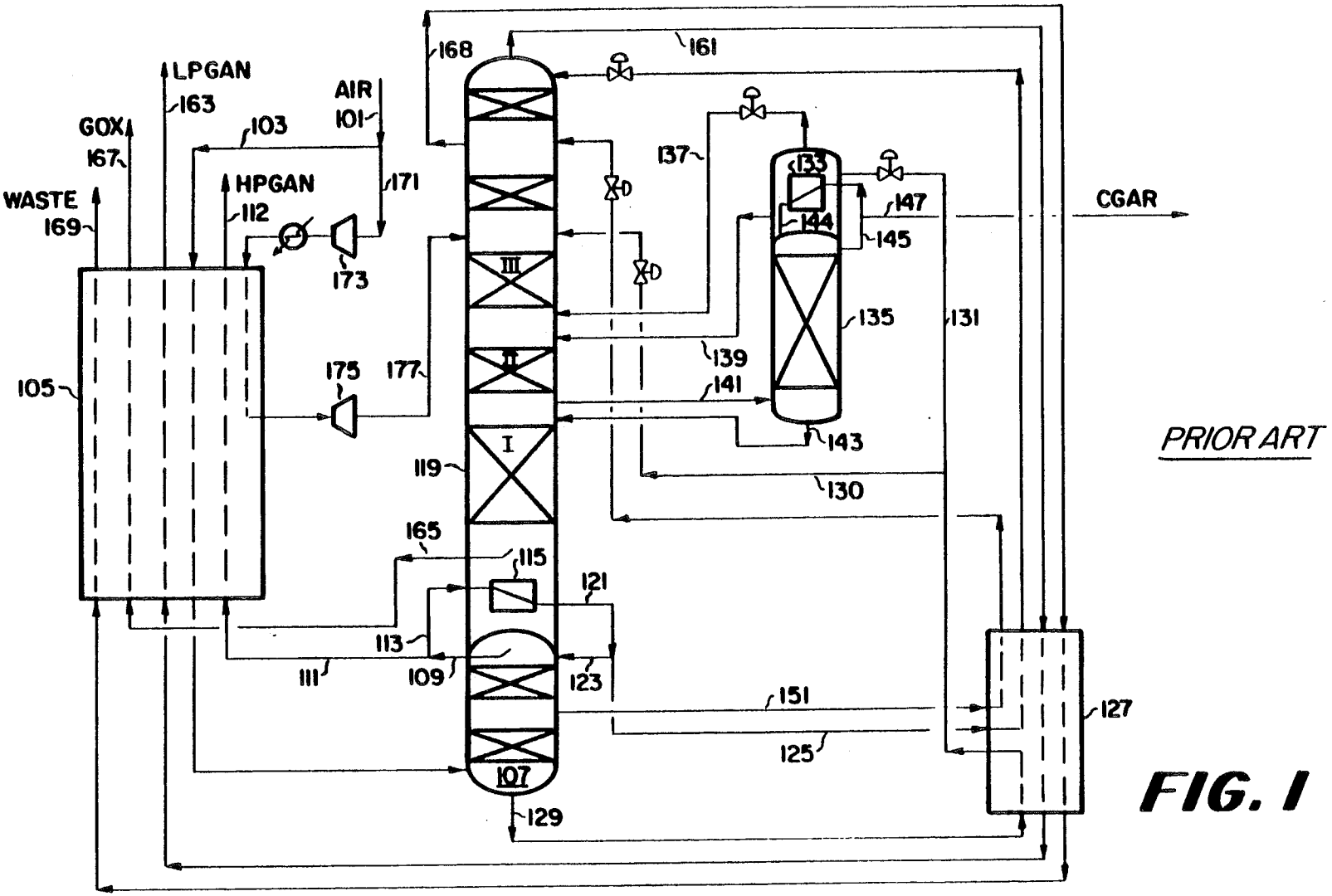
FIG. 1 is a schematic diagram of a typical cryogenic air separation process producing argon as found in the prior art.

To better understand the present invention, it is important to understand the background art. As an example, a typical process for the cryogenic separation of air to produce nitrogen, oxygen and argon products using a three column system is illustrated in FIG. 1. With reference to FIG. 1, a clean, pressurized air stream is introduced into the process, via line 101. This clean, pressurized air stream is then divided into two portions, lines 103 and 171, respectively. The first portion is cooled in heat exchanger 105 and fed to high pressure distillation column 107, via line 103, wherein it is rectified into a nitrogen-rich overhead and a crude liquid oxygen bottoms. The nitrogen-rich overhead is removed from high pressure distillation column 107, via line 109, and split into two substreams, lines 111 and 113, respectively. The first substream in line 111 is warmed in heat exchanger 105 and removed from the process as high pressure nitrogen product, via line 112. The second portion, in line 113, is condensed in reboiler/condenser 115, which is located in the bottoms liquid sump of low pressure distillation column 119, and removed from reboiler/condenser 115, via line 121, and further split into two parts. The first part is returned to the top of high pressure distillation column 107, via line 123, to provide reflux; the second part, in line 125, is subcooled in heat exchanger 127, reduced in pressure and fed to top of low pressure distillation column 119 as reflux.

The crude liquid oxygen bottoms from high pressure distillation column 107 is removed, via line 129, subcooled in heat exchanger 127, and split into two sections, lines 130 and 131, respectively. The first section in line 130 is reduced in pressure and fed to an upper intermediate location of low pressure distillation column 119 as crude liquid oxygen reflux for fractionation. The second section in line 131 is reduced in pressure, heat exchanged with crude argon vapor overhead from argon sidearm distillation column 135 wherein it is partially vaporized. The vaporized portion is fed to an intermediate location of low pressure distillation column 119, via line 137 for fractionation. The liquid portion is fed, via line 139, to an intermediate location of low pressure distillation column 119 for fractionation.

An argon-oxygen-containing side stream is removed from a lower-intermediate location of low pressure distillation column 119 and fed, via line 141, to argon sidearm distillation column 135 for rectification into a crude argon overhead stream and a bottoms liquid which is recycled, via line 143, to low pressure distillation column 119. The crude argon overhead stream is removed from argon sidearm distillation column 135, via line 145., has a crude gaseous argon product stream removed, via line 147, and is then fed to boiler/condenser 133, where it is condensed against the second section of the subcooled, high pressure distillation column, crude liquid oxygen bottoms. The condensed crude argon is returned to argon sidearm distillation column 135, via line 144, to provide reflux. Alternatively, crude liquid argon could be removed as a portion of line 144.

The second portion of the feed air, in line 171, is compressed in compressor 173, cooled in heat exchanger 105, expanded in expander 175 to provide refrigeration and fed, via line 177, to low pressure distillation column 119 at an upper-intermediate location. Also as a feed to low pressure distillation column 119, a side stream is removed from an intermediate location of high pressure distillation column 107, via line 151, cooled in heat exchanger 127, reduced in pressure and fed to an upper location of low pressure distillation column 119 as added reflux.

To complete the cycle, a low pressure nitrogen-rich overhead is removed, via line 161, from the top of low pressure distillation column 119, warmed to recover refrigeration in heat exchangers 127 and 105, and removed from the process as low pressure nitrogen product, via line 163. An oxygen-enriched vapor stream is removed, via line 165, from the vapor space in low pressure distillation column 119 above reboiler/condenser 115, warmed in heat exchanger 105 to recover refrigeration and removed, via line 167, from the process as gaseous oxygen product. Finally, an upper vapor stream is removed from low pressure distillation column 119, via line 167, warmed to recover refrigeration in heat exchangers 127 and 105 and then vented from the process as waste, via line 169.

The current invention suggests a method for enhanced argon recovery from a system which uses a high pressure column, a low pressure column and a crude argon column. The improvement comprises condensing the argon-rich, overhead vapor from the top of the crude argon column in a boiler/condenser against boiling liquid which descends the low pressure column, thereby producing an intermediate vapor boil-up.

Figure 2:
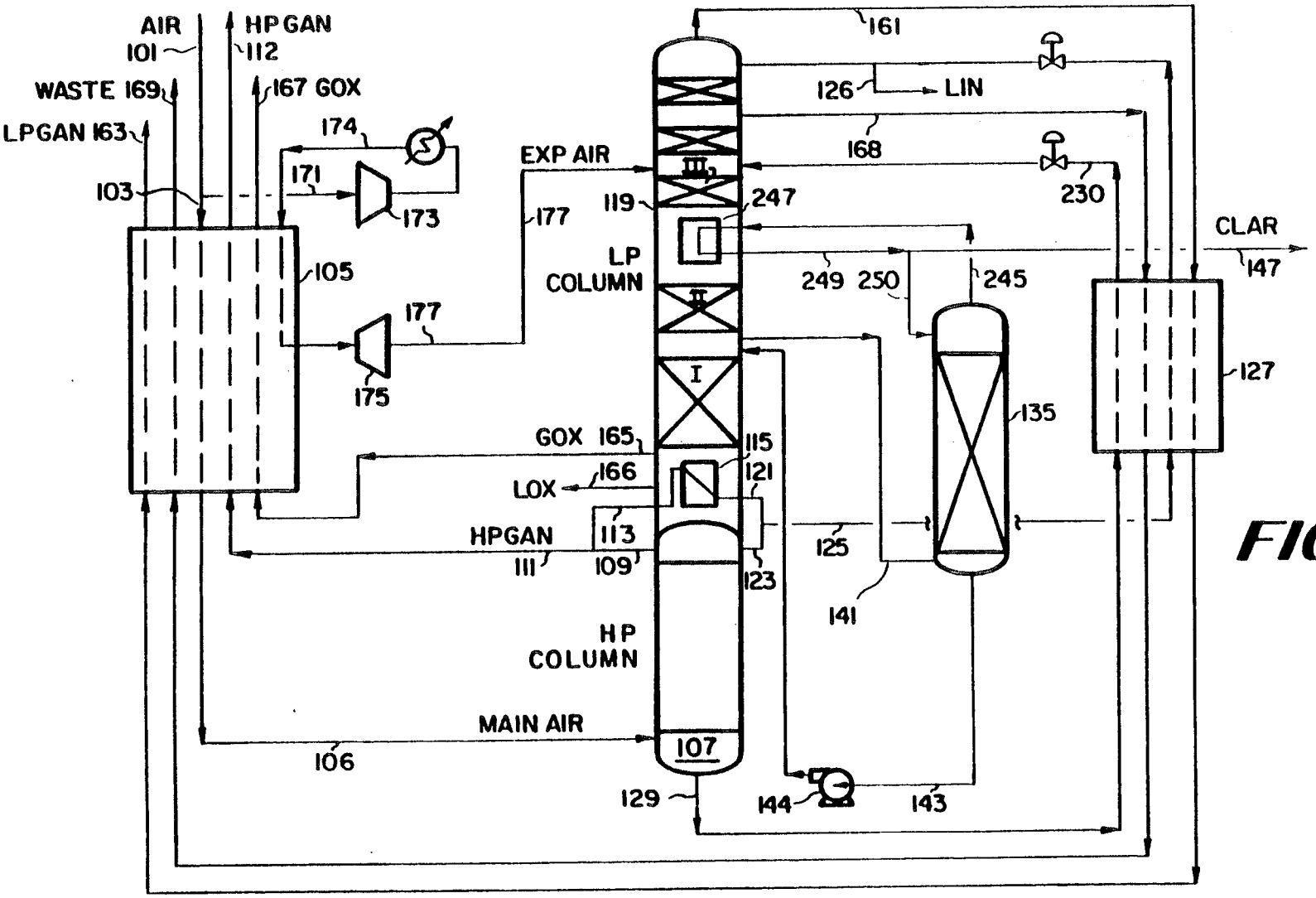
FIG. 2 is a schematic diagram of the process of the present invention.

The invention will now be illustrated with reference to FIG. 2. The process of FIG. 2 is similar in many ways to FIG. 1, however, several significant differences are evident. Similar features of the process utilize common numbering with FIG. 1.

The first and major difference, in that it is the invention itself, is the source of refrigeration for the condensing of the argon-rich vapor, which in this embodiment has been removed via line 245 from the top of crude argon column 135. This vapor is fed to boiler/condenser 247, located in low pressure column 119 between sections II and III. Herein the argon-rich vapor is condensed in indirect heat exchange with intermediate low pressure column liquid which is descending low pressure column 119.

The condensed, argon-rich liquid is removed from boiler/condenser 247, via line 249, and split into two portions. The first portion is fed to the top of crude argon column 135 via line 250 to provide reflux for the column. The second portion is removed from the process via line 147 as crude liquid argon product.

The second difference is that the crude liquid oxygen stream from the bottom of high pressure column 107 is fed to a suitable location in low pressure column, via line 230. No portion of the crude liquid oxygen is boiled against the crude argon from the top of the crude argon column.

A third difference, the use of a liquid pump, such as item 144. arises from the fact that the height of the argon column, 135, is generally greater than the height of Section 11 of the low pressure column, 119. Alternatively, the two columns could be located such that the liquid from the bottom of the crude argon column can free drain by gravity to the low pressure column. In this case, the proper liquid from the suitable section of the low pressure can be collected from a tray and pumped to a boiler/condenser located at the top of the crude argon column. After heat exchange with the crude argon vapor, the resulting fluid is returned to the same location of the low pressure column. Since the pumped liquid is partially vaporized, the returning fluid will constitute a vapor and a liquid stream.

Figure 4:
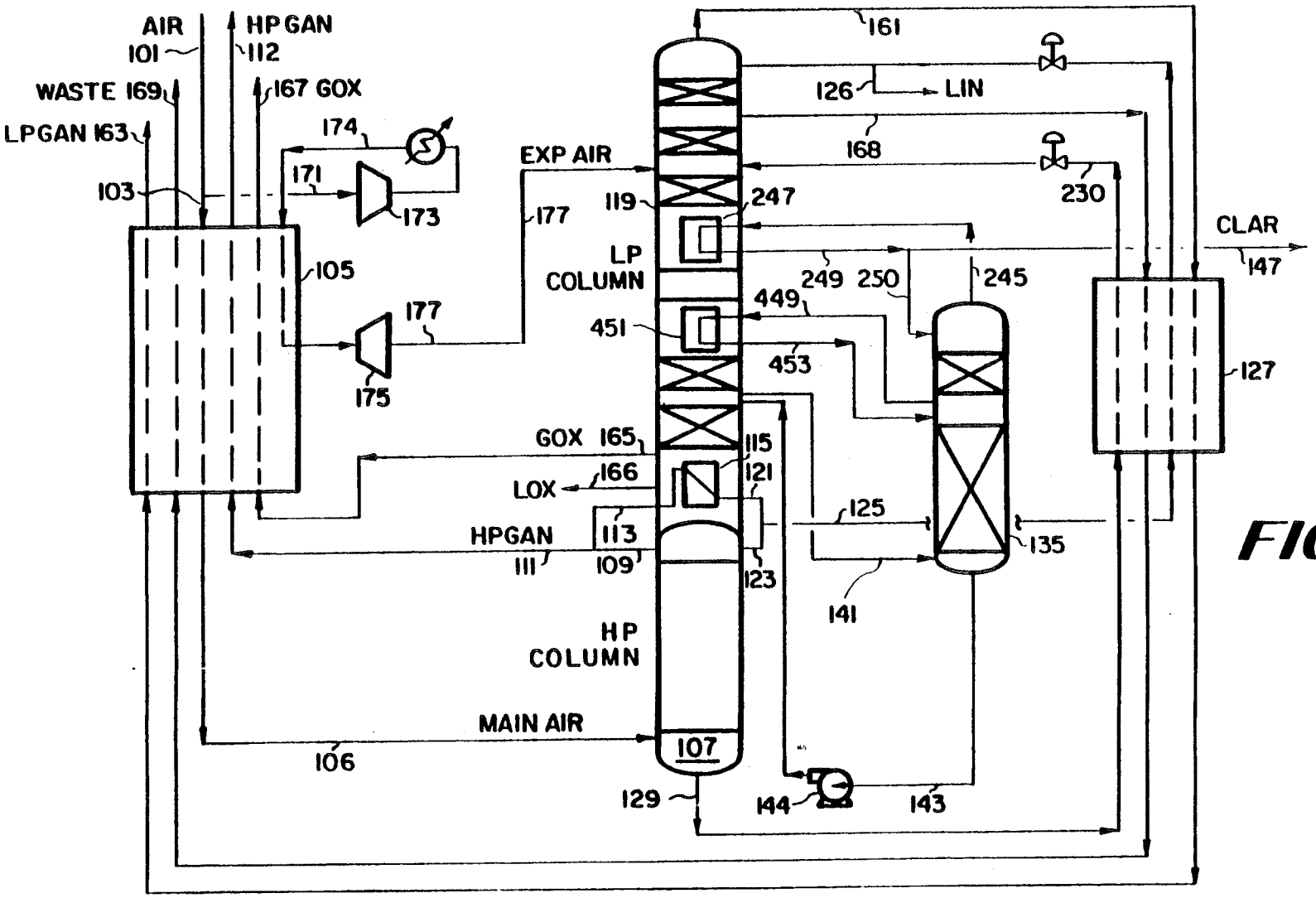
FIG. 4 is a schematic diagram of a further embodiment the process of the present invention.

It is worth mentioning that this invention can be used in conjunction with other ideas which are known to those skilled in this subject. For example, the present idea can be easily combined with the one taught in U.S. Pat. No. 4,670,031. Thus, an additional boiler/condenser 451 can be used which allows the exchange of latent heats between an intermediate point of crude argon column 135 and a location in the suitable section of low pressure column 119, using streams 449 and 453. A suitable location for this case would be as shown in FIG. 4. Similarities between FIG. 4 and FIG. 2 are shown using common identification numbers. This section of the low pressure column is bounded by the tray location where the top of the crude argon column exchanges heat and the tray from where the feed to the crude argon column is withdrawn.

In order to demonstrate the efficacy of the present invention, the following examples are offered.

EXAMPLES

Example 1

A computer simulation was done for the process depicted in the flowsheet of FIG. 2., the results of this simulation are summarized in Table I. The basis for the simulation is that the plant produces all gaseous products along with minor liquid products, liquid oxygen and liquid nitrogen, which are produced such that each are about 0.4% of the feed air flow (stream 101) to the plant. The argon recovery for this case is 90.8%.

TABLE I

Operating Conditions for Selected Streams for the Process of FIG. 2

| STREAM NUMBER | TEMPERATURE °F. | PRESSURE PSIA | FLOWRATE MOL/HR | COMPOSITION: MOL % NITROGEN | OXYGEN | ARGON |
|---|---|---|---|---|---|---|
| 101 | 55 | 86 | 100.0 | 78.1 | 21.0 | 0.9 |
| 106 | −277 | 84 | 87.3 | 78.1 | 21.0 | 0.9 |
| 112 | 55 | 79 | 0.2 | 100.0 | 0.0 | 0.0 |
| 129 | −279 | 84 | 47.6 | 60.0 | 38.3 | 1.7 |
| 141 | −291 | 22 | 32.0 | 0.0 | 92.2 | 7.8 |
| 143 | −291 | 22 | 31.1 | 0.0 | 94.7 | 5.3 |
| 147 | −297 | 20 | 0.9 | 0.1 | 0.2 | 99.7 |
| 163 | 55 | 16 | 64.1 | 100.0 | 0.0 | 0.0 |

TABLE I-continued

| Operating Conditions for Selected Streams for the Process of FIG. 2 | | | | | | |
|---|---|---|---|---|---|---|
| STREAM | TEMPERATURE | PRESSURE | FLOWRATE | COMPOSITION: MOL % | | |
| NUMBER | °F. | PSIA | MOL/HR | NITROGEN | OXYGEN | ARGON |
| 167 | 55 | 19 | 20.6 | 0.0 | 99.8 | 0.2 |
| 169 | 55 | 17 | 13.4 | 99.3 | 0.3 | 0.4 |
| 174 | 87 | 149 | 12.7 | 78.1 | 21.0 | 0.9 |
| 245 | −297 | 20 | 33.5 | 0.1 | 0.2 | 99.7 |

EXAMPLE 2

Figure 3:
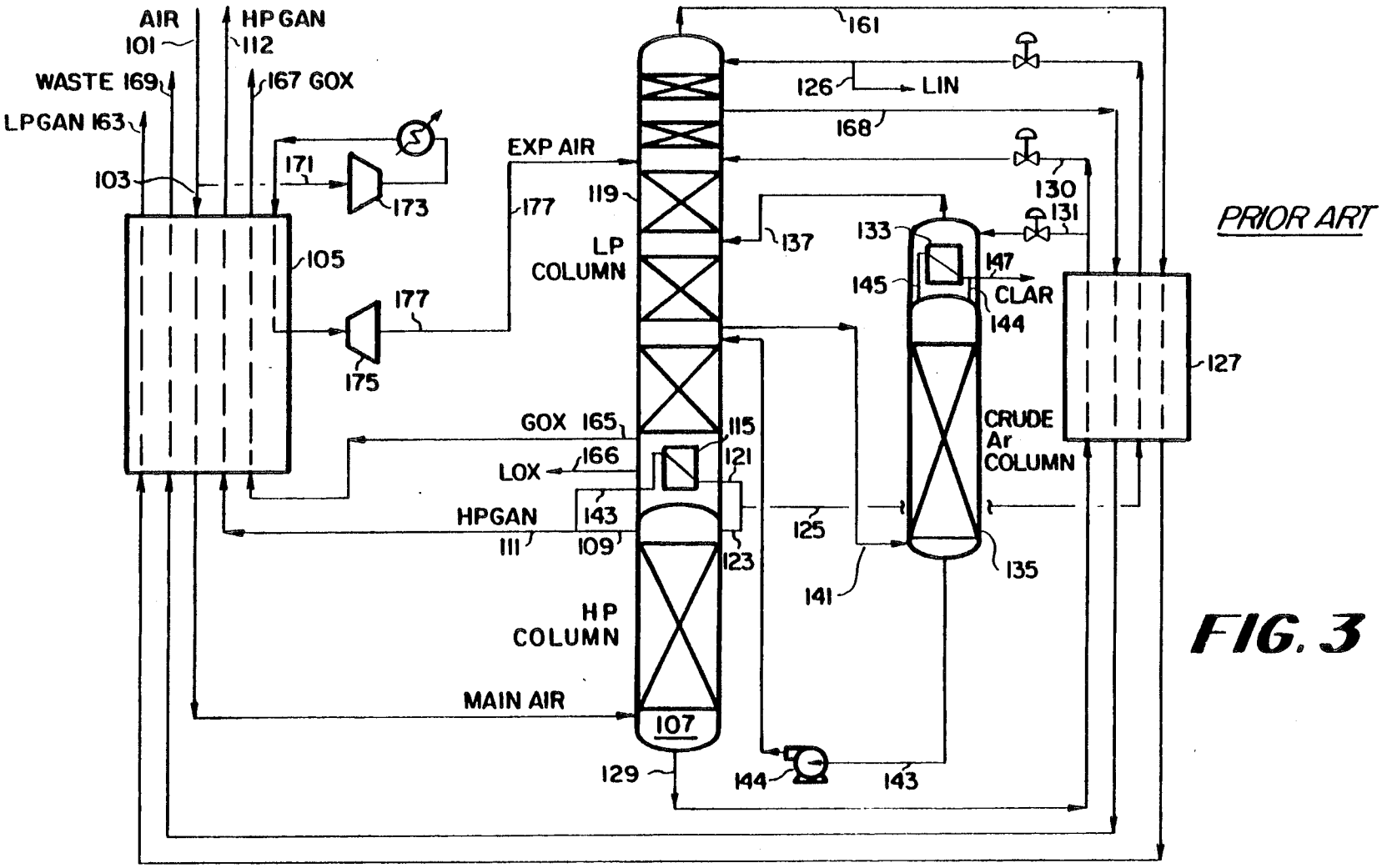
FIG. 3 is a schematic diagram of a second embodiment of a typical cryogenic air separation process producing argon as found in the prior art.

Similar calculations were done for the same product rates for an embodiment of the conventional process as depicted in the flowsheet of FIG. 3. Also, a simulation was done for the process taught in U.S. Pat. No. 4,670,031. The argon recoveries for each case are compared in Table II.

TABLE II

| Argon Recoveries* for Several Processes | | | |
|---|---|---|---|
| | Conventional Process (FIG. 3) | U.S. Pat. No. 4,670,031 | Present Invention (FIG. 2) |
| Argon Recovery (%) | 81.0 | 87.3 | 90.8 |

*Note: Argon recovery is defined as percentage of argon in the feed air which is recovered in the crude argon product stream As compared to the conventional process, the argon recovery by the proposed method is quite high (90.8% vs. 81.0%). It should be noted that the argon recovery achieved by the process of the present invention is even higher than for the process taught in the U.S. Pat. No. 4,670,031. This is particularly significant because the process taught in U.S. Pat. No. 4,670,031 uses an additional boiler/condenser and is more complex.

In summary, the present invention is a better method of thermally linking the top of the crude argon column with the low pressure column and produces argon at higher recoveries.

The present invention has been described in reference to a specific embodiment thereof. This embodiment should not be viewed as a limitation of the scope of the present invention. The scope of the present invention should be ascertained by the following claims.

We claim:

1. In a cryogenic air distillation process producing argon using a multiple column distillation system comprising a high pressure column, a low pressure column and a crude argon column; wherein feed air is compressed, cooled and at least a portion thereof is fed to the high pressure column; wherein in the high pressure, the compressed, cooled feed air is rectified into a crude liquid oxygen bottoms and a high pressure overhead; wherein the crude liquid oxygen bottoms is fed to the low pressure column; wherein in the low pressure column, the crude liquid oxygen is distilled into a liquid oxygen bottoms and a gaseous nitrogen overhead; wherein the low pressure column and the high pressure column are thermally linked such that at least a portion of the high pressure nitrogen overhead is condensed in a reboiler/condenser against vaporizing liquid oxygen bottoms; wherein an argon containing gaseous side stream is removed from a lower intermediate location of the low pressure column and fed at essentially the same pressure to the crude argon column; wherein in the crude argon column, the argon containing gaseous side stream is rectified into an argon-rich vapor overhead and an argon-lean bottoms liquid, and the argon-lean bottoms liquid is returned to the low pressure column; the improvement for increasing argon recovery comprises condensing at least a portion of the argon-rich vapor overhead from the crude argon column by heat exchange in a boiler/condenser against at least a portion of liquid descending the low pressure column selected from a location of the low pressure column between the feed point of the crude liquid oxygen from the bottom of the high pressure column and the removal point for the argon containing gaseous side stream for the crude argon column wherein an adequate temperature differences exists between the descending liquid and the condensation argon, thereby at least partially vaporizing said liquid portion; and returning at least a portion of the condensed argon to a top of the crude argon column to provide liquid reflux.

2. The process of claim 1 which further comprises using at least a portion of said at least partially vaporized liquid portion to provide reflux to the low pressure column.

3. The process of claim 2 wherein said boiler/condenser for the condensation of at least a portion of the argon-rich vapor overhead of the crude argon column is located internal to the low pressure column.

4. The process of claim 1 wherein said boilder/condenser for the condensation of at least a portion of the argon-rich vapor overhead of the crude argon column is located internal to the low pressure column.

5. The process of claim 1, which further comprises condensing a portion of the vapor ascending the intermediate section of the crude argon column by indirect heat exchanger in a second boiler/condenser against liquid descending the low pressure column bounded by the location of the liquid used to condense at least a portion of the argon-rich vapor overhead and the removal point for the argon containing gaseous side stream for the crude argon column and using said condensed portion as intermediate reflux for the crude argon column.

6. The process of claim 3, which further comprises condensing a portion of the vapor ascending the intermediate section of the crude argon column by indirect heat exchanger in a second boiler/condenser against liquid descending the low pressure column bounded by the location of the liquid used to condense at least a portion of the argon-rich vapor overhead and the removal point for the argon containing gaseous side stream for the crude argon column and using said condensed portion as intermediate reflux for the crude argon column; wherein said second boiler/condenser is located internal to the low pressure column.

* * * * *